US005678375A

United States Patent [19]

Juola

[11] Patent Number: 5,678,375

[45] Date of Patent: Oct. 21, 1997

[54] FRAMEWORK OF A BUILDING

[76] Inventor: Tuomo Juola, Katinhäntä 9 A, FIN-21100 Naantali, Finland

[21] Appl. No.: 362,580

[22] PCT Filed: Jul. 6, 1993

[86] PCT No.: PCT/FI93/00286

§ 371 Date: Jan. 9, 1995

§ 102(e) Date: Jan. 9, 1995

[87] PCT Pub. No.: WO94/01630

PCT Pub. Date: Jan. 20, 1994

[30] Foreign Application Priority Data

Jul. 7, 1992 [FI] Finland ..... 923118

[51] Int. Cl.[6] ..... E04H 12/10; E04H 12/14

[52] U.S. Cl. ..... 52/655.1; 52/653.2; 52/236.7; 52/637; 52/721.4

[58] Field of Search ..... 52/236.6, 236.7, 52/653.1, 653.2, 655.1, 721.4, 726.1, 637, 648, 283, 126.1

[56] References Cited

U.S. PATENT DOCUMENTS

| | | | |
|---|---|---|---|
| 3,788,024 | 1/1974 | DeHartog . | |
| 3,829,999 | 8/1974 | Bernstein | 52/653.2 X |
| 4,125,973 | 11/1978 | Lendrihas . | |
| 4,171,598 | 10/1979 | Holmes | 52/726.1 X |
| 4,250,679 | 2/1981 | Burg | 52/653.2 X |
| 4,271,654 | 6/1981 | Jungbluth | 52/637 |
| 4,722,156 | 2/1988 | Sato | 52/721.4 X |
| 4,723,384 | 2/1988 | Mengeringhausen et al. . | |
| 4,925,330 | 5/1990 | Cornish | 52/637 X |
| 5,012,622 | 5/1991 | Sato et al. | 52/721.4 |

FOREIGN PATENT DOCUMENTS

| | | |
|---|---|---|
| 1 784 021 | 7/1971 | Germany . |
| 7113103 | 8/1976 | Sweden . |
| 462 418 | 10/1968 | Switzerland . |

*Primary Examiner*—Wynn E. Wood
*Assistant Examiner*—Yvonne Horton-Richardson
*Attorney, Agent, or Firm*—Pollock, Vande Sande & Priddy

[57] ABSTRACT

A building framework comprises a plurality of steel girders, steel columns, and steel connecting members for joining at least one girder with at least one column to form the building framework. Further provided is a plurality of substantially flat coupling elements, each having opening therein, wherein at least one column and at least one connecting member each terminate with at least one coupling element. The coupling elements substantially match each other and extend outward beyond the outer wall of the column and of the connecting member for providing attachment therebetween. The girders, columns and coupling elements are reinforced with concrete extending through the coupling elements via the openings.

12 Claims, 4 Drawing Sheets

FRAMEWORK OF A BUILDING

FIELD OF THE INVENTION

The present invention relates to a building framework as well as to a method for the construction of a building framework. In particular, the present invention relates to a steel-constructed framework of a multi-storied building.

BACKGROUND OF THE INVENTION

High quality of prefabricated elements manufactured in a favorable production environment and especially their dimensional accuracy is one of the most obvious benefits of a prefabricated steel framework. A steel framework requires first-class design work. The use of accurate building elements or components facilitates considerably erection of a building framework as well as the other outfitting of a framework. However, the relative market share of building frameworks that are completely made of steel is quite modest. This is due to a number of problems associated with framework systems intended for industrial production.

Swedish publication SE 7113103 discloses a structure for connecting a plurality of horizontal girders to a column for producing a building framework. The top portion of a column of a square cross-section is provided with a square flange surrounding the column and holes for attachment. A horizontal girder of a U-shaped cross-section is placed on top of the column so that the flange of the girder and one side of the square flange of the column will be in cooperation with each other. The slabs are supported on top of the girders i.e., on the top edge of a girder. Thus, it is possible to place a total of four girders on top of a column in parallel with each side of the square This type of solution involves several problems. It is necessary to place the horizontal girders on the edges of a column, which results in an asymmetric structure whenever the joint includes less than four girders. Thus, the load of the girders on a column will be eccentric tending to bend the column. Also the attachment moments of girders on the support tend to distort the column. The girders in a joint do not create a functional unit but are each separately connected with a supporting column through the intermediary of a flange. Hence, each girder applies individually a load on that flange of a column to which it is attached. When the number of girders is less than four, it is necessary to employ separate spacers mounted on those sides of a column flange having no horizontal girder. Neither is it possible to fill the columns with concrete, since the girders are detached from each other at the junction points. Due to an irregular and asymmetric disposition of the girders, such a structure is suitable neither for the regular modular network of a building framework, nor for the modular dimensioning of building elements.

U.S. Pat. No. 4,125,973 discloses a form assembly comprising sheet metal, hollow, flanged corner joints which telescopically engage the adjoining ends of elongated sheet metal forms for girders and columns. The adjoining structural parts are slidingly fitted and affixed to the corner joint by metal straps. After interconnection the forms are filled with concrete to complete the framework of the building. The rigidity obtainable by the disclosed framework is insufficient for multi-storied buildings. Furthermore, the corner joints are not provided with planar coupling elements. This greatly complicates the construction of the framework in the building site. It is important that the joining surfaces are flat allowing a heavy girder to be simply hoisted in place between two columns.

SUMMARY OF THE INVENTION

An object of the invention is to provide a building framework which is well adapted to prefabrication and which can be quickly erected. Another object is to provide a building framework which primarily comprises conventional, commonly available profiled steel elements.

A steel-constructed building framework of the invention is assembled from columns and girders. The columns have a height which essentially corresponds to the room height in a finished building. The columns are erected floor by floor and the girders are connected between the columns. The floor-by-floor erectable columns are advantageous for the erection of the rest of the framework and for the outfitting. During installation of girders and slabs there will be no obstacles impeding the assembly work in the working space as is the case when using columns having a height of several stories. The columns are hollow building elements comprising prefabricated, standardized tubular parts. The girders are, for example, so-called Delta girders or HQ-girders fitted inside a slab assembly. A Delta girder includes a web and flanges on either side thereof at the bottom edge of a girder and extending away from the web in a substantially horizontal direction. The web includes two web sections, which are provided with openings and set in a position inclined towards each other and connected to each other by means of a horizontal top section. The flanges are included in a girder bottom plate, extending beyond the web on either side thereof. The girder bottom plate can also be of a separate piece, in which case the flanges are integral with the web. In an HQ-girder, the web sections are vertical. According to the present invention, connecting members are used at the junction points of the building framework for joining the columns and girders to each other. The connecting members are box-shaped elements made of steel sheet. The columns, girders and connecting members are provided with coupling elements to enable the attachment of building elements to each other. All coupling elements to be fitted against each other in the framework are exactly compatible and the holes of fastening bolts will be precisely in alignment with each other. Thus, the pre-planned erection of the framework requires high dimensional accuracy of the parts. Hence, the entire framework shall retain its strictly designed dimensions which facilitates the use of prefabricated building and outfitting elements.

Various loading conditions on a building framework are taken into account by selecting appropriate profile sizes, material thickness as well as number of fastening bolts. Thus, the same framework can be used in various buildings and in various loading conditions, only the dimensions of elements and material thickness will be changed. A composite structure is also possible. In this case, the columns, joining elements and possibly even the girders are filled with concrete for increasing the rigidity of a joint especially when fitting steel reinforcements in the cast concrete of a joint. The fire resistance of a structure will also improve. Even a highly diversified building framework can be assembled from the same simple basic elements. The simplicity and clearly defined features of a framework structure provide an economical advantage. Another advantage is provided by the present invention when striving for the standard dimensioning of a product.

The structure is highly suitable for export purposes. The prefabricated connecting members and coupling elements of columns and girders are readily transportable to a construction site by virtue of their light weight and small size. On the other hand, columns and girders used in the framework structure are commonly available and, thus, their supply shall not be a problem under any circumstances. A building framework of the invention enables the use of known floor structures and facade systems. A light-weight intermediate floor is beneficial for the system and such a floor can also be readily disassembled. A building framework of the invention serves just as well as the framework for a residence as an industrial building.

BRIEF DESCRIPTION OF THE FIGURES

The invention will now be described in more detail with reference made to the accompanying drawings, in which.

DETAILED DESCRIPTION OF THE INVENTION

Figure 1:
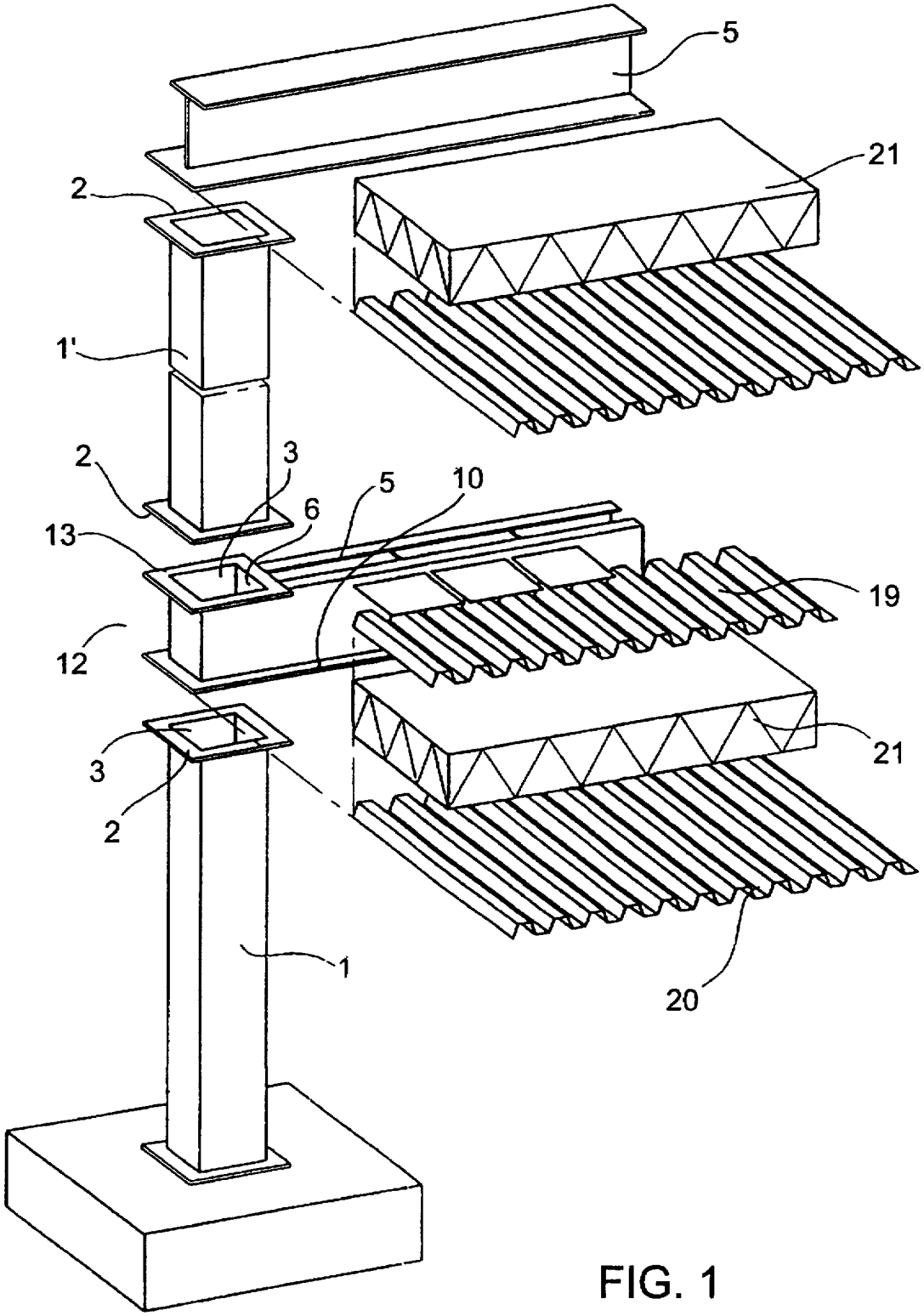
FIG. 1 shows a building framework according to a first embodiment of the present invention, wherein a connecting member is provided at the end of an HQ-girder.

According to the first embodiment of the present invention as shown in FIG. 1, the building framework comprises columns 1 of a square cross-section and HQ-girders 5. The height of column 1 is lower than the floor height of a building by the height of girder 5. Therefore, column height corresponds to room height. Each end of column 1 is fitted with a square-shaped coupling element 2 of a column, extending in a substantially horizontal direction from the wall of column 1 and made of steel sheet. The coupling element 2 of a column is provided with a central opening 3 for reinforcing the column and filling it with concrete. The coupling element 2 of a column may just as well be a plate element, covering the head of a column and provided with a flange and an opening. The coupling element 2 of a column is provided with necessary fastening holes (not shown in FIG. 1) for fastening the column 1 with bolts to a connecting member 12 placed thereupon. In a corresponding fashion, a column 1' placed on top of connecting member 12 is fastened with bolts to connecting member 12.

As pointed out above, the girder 5 included in a building framework comprises in the first embodiment a so-called HQ-girder. An HQ-girder includes a web and flanges 10, extending in a substantially horizontal direction away from the web on either side thereof along the bottom edge of an HQ-girder. Flanges 10 form a part of the girder bottom plate and form one piece with the bottom plate. The web comprises two vertical web sections connected to each other by means of a horizontal top plate. The top plate is provided with casting openings for filling the girder with concrete.

The end of girder 5 is provided with a box-shaped connecting member 12 so that part of the top plate of an HQ-girder has been removed and replaced by a horizontal coupling element 13 on the top edge of girder 5 serving as a footing for column 1' of the next floor. The horizontal coupling element 13 of a connecting member 12 is also a square-shaped plate provided with a central opening 3. The coupling element 13 of connecting member 12 and the coupling element 2 of a column fitted at the bottom end of column 1' to be placed thereupon match each other in shape, i.e. they are mutually congruent. Thus, the opening and fastening holes included in coupling elements 2, 13 will exactly match together. The bottom coupling element of connecting member 12 is made of the HQ-girder bottom plate with necessary portions thereof cut away for concrete casting. Even in this case it is compatible with the coupling element 2 of the column below. If necessary, the concrete reinforcements for columns can be extended through the box-shaped connecting member 12 continuously from one column to another and the column can be cast full of concrete. On the side facing girder 5 the connecting member 12 is provided with a wall 6, which is in flush with the wall of column 1,1' facing the girder and which prevents the casting from entering the girder 5. Another possible solution is the one in which the girder 5 is filled with concrete. In that case, the wall 6 of the connecting member 12 is provided with necessary reinforcing and casting openings 7.

FIG. 1 illustrates one floor structure for use in connection with a framework of the present invention. The floor comprises two trapezoidally bent steel sheets 19, 20, between which is fitted, for example, a hard mineral wool panel 21. On top of the floor can be laid a conventional covering board and a floor coating. The floor is supported on the HQ-girder flanges 10 and the floor structures extend all the way to an external wall structure.

Figure 2:
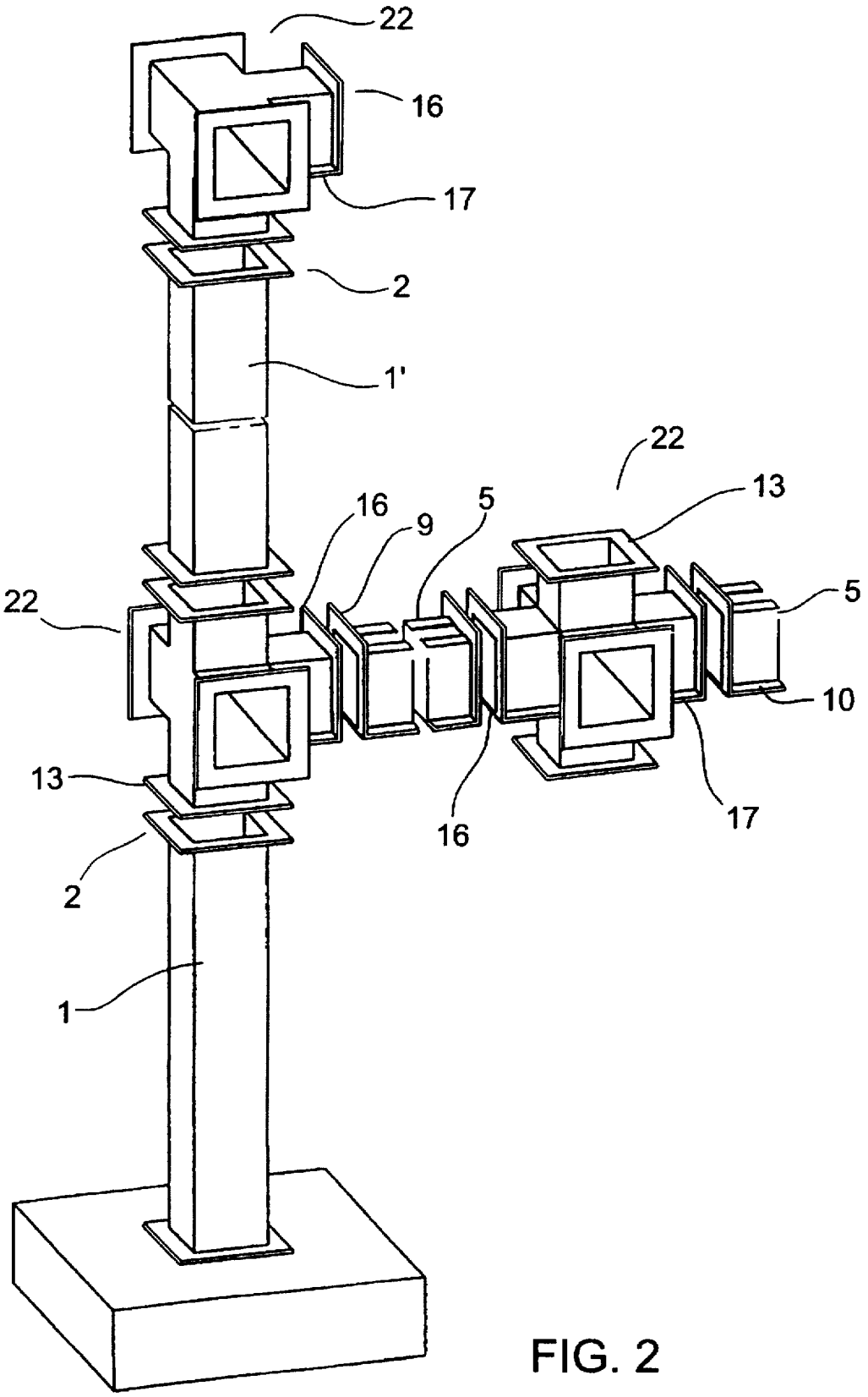
FIG. 2 shows a building framework according to a second embodiment of the present invention, wherein a connecting member comprises a multi-branched element consisting of tubular girders.

As shown in FIG. 2, the girder 5 can also be connected to a multi-branched connecting member 22. The connecting member 22 is provided with a vertical coupling element 16 of a connecting member. The girder 5 also has a vertical coupling element 9 which is compatible with the coupling element 16 of the connecting member 22. The vertical coupling element 16 of the connecting member 22 as well as the vertical coupling element 9 of the girder 5 are square-shaped. The coupling element 9 is mounted on the end of the girder 5. At the bottom edge of the girder 5 it fastens to an HQ-girder flange 10. The connecting member 22 is also provided with a flange plate 17 matching the flanges 10 of the HQ-girder. The flanges extend continuously over the length of the entire girder system. The box of connecting member 22 may also have its interior fitted with vertical reinforcement plates or other additional supports in flush with the column walls.

FIG. 2 illustrates a number of different connecting members 22 for use in a building framework. The connecting member 22 includes at least one horizontal coupling element 13 of a connecting member compatible with a coupling member 2 of a column and at least one vertical coupling element 16 of a connecting member compatible with a vertical coupling element 9 of a girder. In case the building framework only comprises vertically positioned columns 1 and horizontally positioned girders 5, the connecting member 22 will be provided with no more than two horizontal coupling elements 13 of a connecting member and four vertical coupling elements 16 of a connecting member. Any intermediate configuration between the above extreme cases is possible for a connecting member. It is natural that the girder systems may also form a relative angle which is different from the right angle. In this case, the corresponding vertical coupling elements of a connecting member form the corresponding relative angle with each other. In a similar fashion, the connecting members 12 can be used in frameworks, where the columns are not necessarily vertical. In this case, if necessary, the "horizontal" coupling elements can be in an inclined position.

Figure 3:
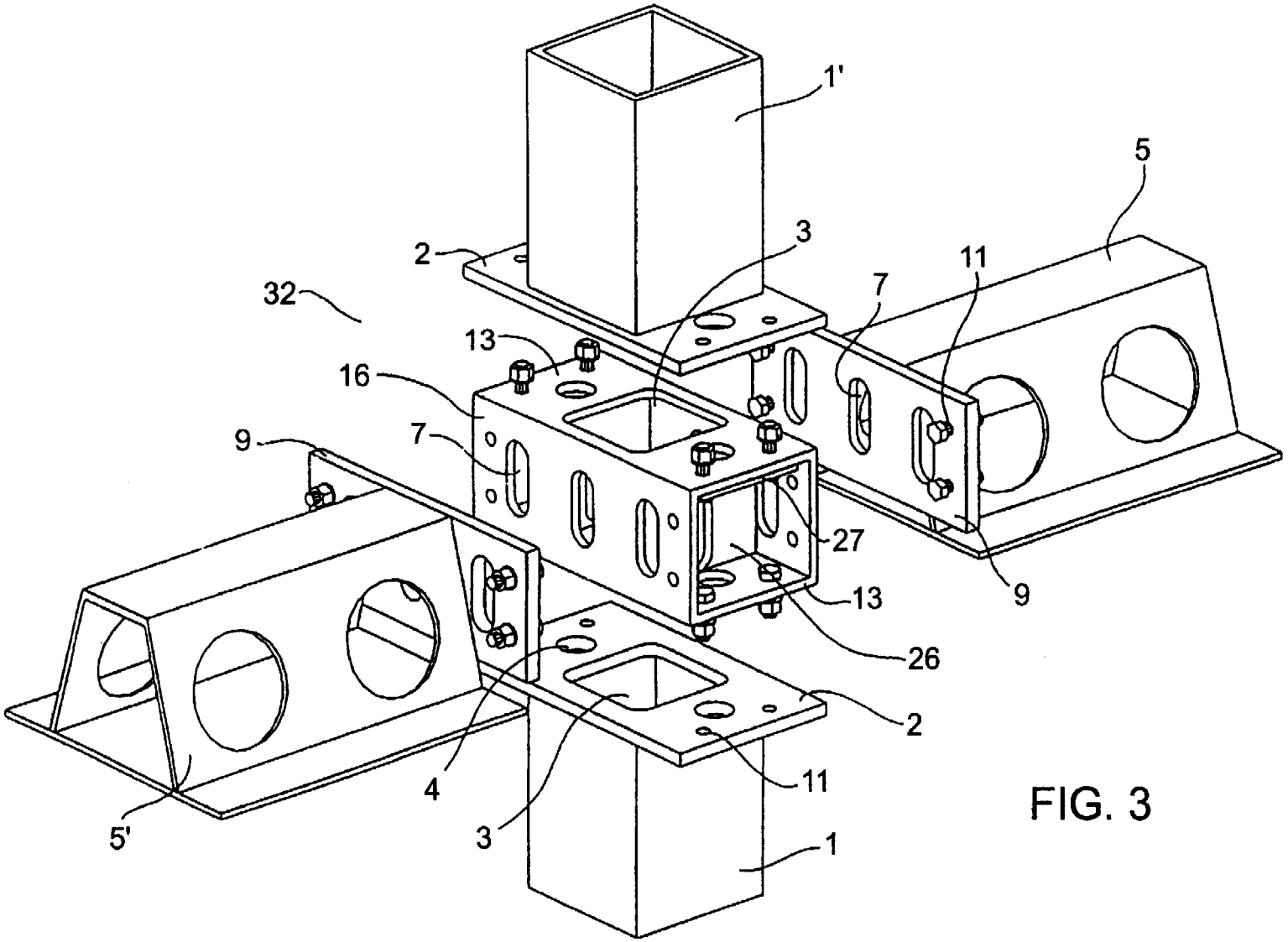
FIG. 3 shows a building framework according to a third embodiment of the present invention, wherein a connecting member comprises an element having a shape of a rectangular prism.
Figure 4:
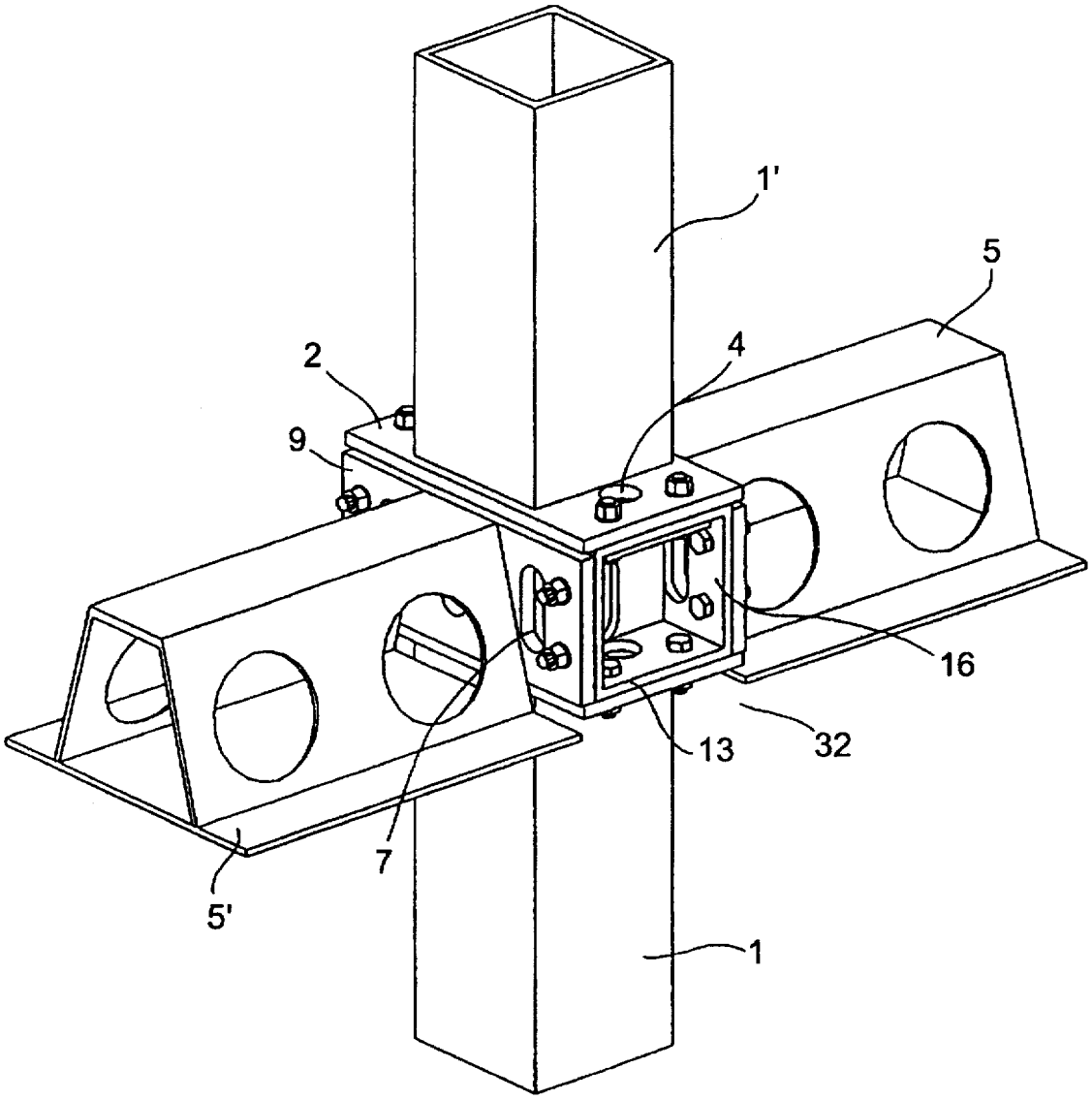
FIG. 4 shows a connecting member of FIG. 3 fastened to columns and girders.

FIGS. 3 and 4 illustrate a third embodiment of the present invention, where the junction points of a building framework are provided with connecting members 32 having a form of a rectangular prism in this connecting member 32, the sides of the prism serve as coupling elements 13, 16.

This embodiment is particularly preferred whenever the purpose is to cast the building elements full of concrete. The concrete reinforcements to be included in cast concrete are led continuously through connecting member 32. The junction point will be provided with a joint, wherein the columns and girders are connected together at least partially in a flexurally rigid fashion.

According to FIG. 3, the end of square-shaped column 1 is provided with a rectangular coupling element 2, covering partially the column head and extending beyond the column walls. The opposite sides of coupling element 2 form long flanged extensions and narrower flanged extensions on the sides facing the girders. An object of the narrow flanged extension is, during the erection of the framework, to receive the end portion of the girder 5 and, thus, to facilitate the erection of the framework. Hence, the flanged portion serves as a footing for the girder facilitating the erection. During the installation of a girder said coupling element 9 of the a girder is placed on top of a the flanged portion. Thus, the coupling element 2 is larger than the corresponding coupling element 13 of the connecting member 22 by the extent of these narrow flanged extensions. Thereafter, the attachment can be effected by means of bolt fastening. In FIG. 3, the girder comprises a so-called Delta girder.

During the installation of an upper column 1', the erection process can be facilitated by fastening the bolts to the coupling element 13 of a connecting member 32, for example, by welding at the bolt head or by using a separate base plate 27.

The coupling element 2 of a column is provided with a square-shaped central opening 3 for facilitating the filling of column 1 with concrete and the passage of a concrete reinforcement of the column through the joint as well as with two circular openings 4, through which the cast concrete can be compacted and which are also used for leading through the joint some wires and tubes etc. included in a building. The coupling element 2 of a column is also provided with openings 11 for fastening bolts. The bottom end of column 1' is fitted with a corresponding coupling element.

The connecting member 32 is used for fixing two girders 5, 5' to columns 1, 1'. Thus, the connecting member 32 serves as a junction element at the junction point between columns and girders. The ends of girders 5, 5' are provided with a vertical, flat coupling element 9 which includes three elliptically shaped openings 7 for leading through concrete reinforcement for the girder and slabs as well as for concrete casting. The edge of coupling element 9 includes openings 11 for fastening bolts.

The connecting member 32 comprises two vertical and two horizontal side plates. Both ends of connecting member 32 are open. In addition, the connecting member 32 includes two vertical support plates 26, which are in alignment with the column flanks and fitted inside the connecting member 32. The fact that the ends are open facilitates the fixing of girders 5, 5' to connecting member 32 as well as the filling of a joint with cast concrete. The vertical side plates to the connecting member 32 include vertical, elliptically shaped openings 7 for through-going concrete reinforcement and concrete casting. A corresponding opening 7 is also included in the support plates 26 of the connecting member. The horizontal side plates of connecting member 32 is provided with a central, square-shaped concrete reinforcing and casting gate 3 and circular openings 4 on either side thereof for the compaction of cast concrete and vertical installations of wires and pipes. Holes 11 for fastening bolts are included in the edge portions of the side plates.

The intermediate floor of a building can be constructed by using, for example, hollow slabs. During the installation, the ends of hollow slabs are supported on the girder flanges. The erection of a building framework proceeds as follows. The first floor columns are erected and columns and girders are secured together through the intermediary of box-shaped connecting members. This is followed by the installation of hollow slabs. As soon as installation of the first floor hollow slabs is completed, the framework is filled with concrete. Casting can be performed, for example, in two stages by first filling the columns with concrete and followed by filling the hollow slab joints, the internal girders of the slab assembly, and the connecting members with concrete. This is followed by the erection of the next floor columns. A face slab is cast thereafter or at some later stage during the construction work. It should be noted that during the casting operation the fastening bolts will be covered by the cast and, at the final stage, a face slab also covers those fastening bolts used in the erection of the columns of the next floor.

When using a framework of the invention, there are always clear and unobstructed working conditions on the working level. In other words, there will be no columns several stories high to impede, for example, the installation of hollow slabs, since the building is constructed by using columns having a height equal to the room height and the building is erected one level at a time. As soon as the cast concrete has attained a sufficient strength, the erection of the next floor columns can be commenced. In addition, the finished space located below a working level serves as a storage during the course of construction work.

As pointed out above, in a building framework according to a third embodiment of the invention the columns 2 and girders 5 extend continuously through the building framework and the junction points have flexural rigidity. Thus, the building framework provides an integral, functional unit, a cage structure whereby the overall stability of a building can be achieved entirely or at least partially by means of the framework. The column spaces in the direction of girders are about 4–8 m and the space between the main lines (girder lines) can be even 4–16 meters, depending on the type of the slab assembly.

The invention is not limited to the above embodiments but it can be modified within the scope defined by the claims. In one practical solution, for example, just the bottom floor columns and girders of a building are filled with concrete. A building framework of the invention can also be constructed, for example, by using columns having a circular cross-section.

The invention claimed is:

1. A building framework having interconnecting girders and columns in which the intersection of a girder with a column is joined by a connecting member shaped as an approximately rectangular parallelpiped, each said girder and each said column defining an inner, substantially enclosed, volume extending over its length, each said connecting member substantially matching each other in size and shape and being substantially hollow for receiving concrete therein subsequent to its interconnection with one or more girders and one or more columns for conveying concrete into said inner volume of the adjoining one or more inner volumes of the girders and columns affixed thereto, multiple sides of said connecting member defining at least one opening therein to enable multiple columns and at least one girder to terminate at each said connecting member, wherein said multiple sides of said connecting member are provided with coupling elements extending laterally beyond the outer periphery of said sides of said connecting member, which coupling elements on free ends of at least some of said columns and said girders whereby said columns and girders may be interconnected with said connecting members and the interior volumes of said columns and girders may be at least partially filled with, and be reinforced by, the concrete in said columns, girders, and connecting members.

2. A building framework, comprising:

a plurality of girders;

a plurality of columns;

a plurality of connecting members for joining each said girder with at least one said column to form said building framework; and a plurality of substantially flat coupling elements each having an opening therein, each said connecting member and each said column terminating with at least one said flat coupling element, each said coupling element extending laterally outwardly beyond the outer periphery of each said respective column, and said respective coupling element for providing attachment therebetween, whereby said girders, columns and coupling elements may be reinforced with concrete extending through said coupling elements via said openings, and wherein said connecting member is open at both ends and includes two vertical perforated support plates extending laterally outwardly beyond the outer periphery of said connecting member to be flush with a wall line of said column and extending parallel to said girder.

3. The apparatus according to claim 2, wherein each said girder terminates with at least said coupling element for providing attachment between said girder and said connecting member.

4. The apparatus according to claim 2, wherein said connecting member is formed at the end of said girder.

5. The apparatus according to claim 2, wherein said connecting member is shaped as a rectangular prism having horizontal and vertical sides forming said coupling elements.

6. The apparatus according to claim 5, wherein said vertical sides include at least substantially elliptically shaped concrete reinforcing and casting gate.

7. The apparatus according to claim 5, wherein said horizontal sides include at least one substantially square-shaped concrete reinforcing and casting gate.

8. The apparatus according to claim 5, wherein said horizontal sides further include a substantially circular installation opening for piping.

9. The apparatus according to claim 2, wherein said coupling element further includes a horizontal flanged portion for forming an extension of a horizontal side face of said connecting member to serve as a footing for facilitating the installation of said girder.

10. The apparatus according to claim 1, wherein said coupling elements include substantially horizontal flat flanges extending laterally beyond and around the outer periphery of said sides of said connecting members.

11. A building framework, comprising:

steel-made girders;

steel-made box-shaped columns; and steel-made box-shaped connecting members for joining said columns and girders together to form said building framework, wherein said columns, girders, and connecting members include substantially flat coupling elements having openings therein for joining one connecting member with at least one of said girders and columns, wherein said columns, girders, and connecting members are reinforced and filled with concrete such that the reinforcement extends through said one connecting member via said openings, wherein said one connecting member is shaped as a rectangular prism having horizontal and vertical sides form said coupling elements, and wherein said one connecting member is open at both ends and includes two vertical perforated support plates placed in flush with the wall line of a column and extending parallel to a girder.

12. A building framework, comprising:

steel-made girders;

steel-made box-shaped columns; and steel-made box-shaped connecting members for joining said columns and girders together to form said building framework, wherein said columns, girders, and connecting members include substantially flat coupling elements having openings therein for joining one connecting member with at least one of said girders and columns, wherein said columns, girders, and connecting members are reinforced and filled with concrete such that the reinforcement extends through said one connecting member via said openings, wherein said one connecting member is shaped as a rectangular prism having horizontal and vertical sides form said coupling elements, wherein said vertical sides of said one connecting member include three substantially vertical elliptically shaped concrete reinforcing and casting gates, and wherein said one coupling element further includes a horizontal flanged portion extending from said column at said coupling element for forming an extension of a horizontal side face of said connecting member to serve as a footing for facilitating the installation of said girder.

* * * * *